US007988407B2

(12) United States Patent
Hsu et al.

(10) Patent No.: US 7,988,407 B2
(45) Date of Patent: Aug. 2, 2011

(54) AXIAL FAN

(75) Inventors: Wei-Chun Hsu, Taoyuan Hsien (TW); Shun-Chen Chang, Taoyuan Hsien (TW); Wen-Shi Huang, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 1206 days.

(21) Appl. No.: 11/393,858

(22) Filed: Mar. 31, 2006

(65) Prior Publication Data

US 2006/0289532 A1 Dec. 28, 2006

(30) Foreign Application Priority Data

Apr. 28, 2005 (TW) ..... 94113694 A

(51) Int. Cl.
*F04D 29/38* (2006.01)
*F04D 29/54* (2006.01)

(52) U.S. Cl. ..... 415/77; 415/116; 415/220; 415/223; 415/211.2; 415/218.1; 415/219.1; 416/175; 416/203; 416/193 R

(58) Field of Classification Search ..... 415/77, 415/78, 116, 202, 220, 222, 223, 211.2, 218.1, 415/219.1; 416/175, 203, 191, 193 R
See application file for complete search history.

(56) References Cited

U.S. PATENT DOCUMENTS

| | | | | |
|---|---|---|---|---|
| 1,225,053 | A * | 5/1917 | Pitts, Sr. | 416/159 |
| 3,262,635 | A * | 7/1966 | Smuland | 415/77 |
| 3,282,053 | A * | 11/1966 | Messerschmitt | 416/193 R |
| 3,904,324 | A * | 9/1975 | Flatt et al. | 416/193 A |
| 4,895,489 | A * | 1/1990 | Kohama et al. | 415/218.1 |
| 5,275,533 | A * | 1/1994 | Kapich | 415/202 |
| 6,591,873 | B1 * | 7/2003 | McNeil | 416/198 R |
| 6,652,225 | B2 * | 11/2003 | Esa | 415/220 |
| 6,910,862 | B2 * | 6/2005 | Horng et al. | 415/211.2 |
| 2006/0222536 | A1 * | 10/2006 | Chang et al. | 417/423.1 |

* cited by examiner

*Primary Examiner* — Christopher Verdier
(74) *Attorney, Agent, or Firm* — Birch, Stewart, Kolasch & Birch, LLP

(57) ABSTRACT

An axial fan is provided. The axial fan includes a base, a rotor, a guide and a plurality of blades. The guide connects to a guide tube to provide airflow. Each blade has a passive part and an active part, wherein the passive part is driven by the airflow from the guide to rotate the active part synchronously. The axial fan increases air quantity and decreases air pressure to provide efficient heat dissipation.

13 Claims, 5 Drawing Sheets

1

AXIAL FAN

BACKGROUND

The invention relates to a fan, and in particular, to an axial fan without a motor.

A conventional fan is normally operated in coordination with a motor providing power to activate the fan. Pivotally connecting the fan with a shaft of the motor, the motor provides motive power to rotate the fan.

However, the structure of the conventional fan presents numerous disadvantages. The first problem is the cost and the bulk of the motor. Since the conventional fan cannot be used without a motor, the cost of the motor is unavoidable. In addition, increased bulk is necessary due to the motor requirement, even when the motor is further simplified. The second problem is that dedicated power is required for the motor. When applied in an electronic device, the motor consumes electrical energy to allow the fan to dissipate heat. The electronic device may even require multiple fans positioned in different areas of the device to dissipate heat. As a result, the power consumption of the electronic device is increased. In a century which environmental consciousness becomes an important issue, improvement in the power consumption of the conventional fans is necessary.

SUMMARY

The invention provides an axial fan. The fan is driven by an airflow from an outlet of a guide. The axial fan functions properly without requiring a motor and thus conserving energy.

The guide of the disclosed axial fan receives connection of a guide tube so that the axial fan provides easier fabrication and lower cost.

As shown in FIG. 1, the axial fan 1 includes a base 10, a rotor 12, a guide, at least one blade 14 and a housing 16. The rotor pivotally mounts on the base by a shaft. The guide connects to the base, and the blade disposes around the rotor. The blade includes a passive part and an active part. The passive part positioned relative to the guide pivots on the shaft and can be driven by an airflow from the guide to rotate the active part.

According to the above conception, the passive part is positioned near the rotor, and the active part is positioned away from the rotor.

According to the above conception, the passive part divides the airflow from the guide into two parts. A pressure difference produced by the two parts of the airflow pivots the passive part on the shaft.

According to the above conception, the passive part has a wing-shaped cross section.

According to the above conception, the active part of the blade pivots on the shaft to create a lower pressure at an end of an outlet than a pressure at another end of the outlet so that the fan can generate the airflow.

According to the above conception, the shaft is positioned on a bearing to pivotally mount on the base.

According to the above conception, the bearing is a sleeve, a ball, or a magnetic bearing.

According to the above conception, the axial fan further includes an extended part and a housing, wherein the extended part connects the housing and the base, and the extended part is a rib or a guiding vane.

According to the above conception, the guide is connected to the housing by at least a support, wherein the support is a rib or a guiding vane.

According to the above conception, the housing includes a first case and a second case, wherein the support connects the guide and the first case, and the extended part connects the base and the second case.

According to the above conception, the rotor has a cross section in a parabolic shape, an elliptical shape, a square shape with rounded corners, or a curved shape.

According to the above conception, a top portion of the rotor extends into the guide so that the rotor guides the airflow to the passive part.

According to the above conception, the guide includes a connecting portion at an inlet of the guide for a guide tube to connect with the guide.

According to the above conception, the axial fan of the present invention can be driven without a motor.

According to the above conception, the blade further includes a first partition positioned between the passive part and the active part, wherein the first partition is annular. The first partition can also be disposed only on the blade between the passive part and the active part, in which the first partition is a hollow cylinder.

According to the above conception, the extended part further includes a second partition positioned thereon, wherein the second partition is annular. The second partition can also be disposed only on the extended part, in which the second partition is a hollow cylinder.

DESCRIPTION OF THE DRAWINGS

The invention can be more fully understood by reading the subsequent detailed description and examples with references made to the accompanying drawings, wherein.

DETAILED DESCRIPTION

Figure 1:
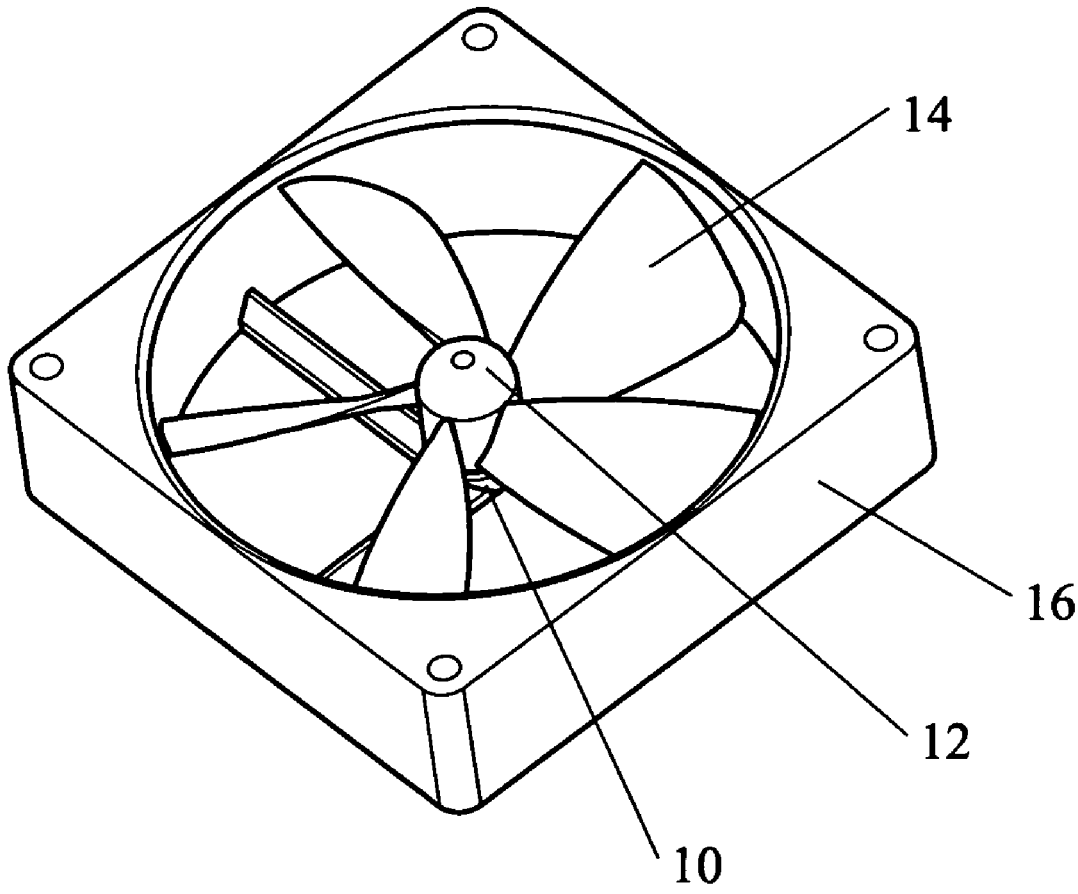
FIG. 1 is a schematic diagram showing a base and blades of an axial fan.

As shown in FIG. 1, the axial fan 1 includes a base 10, a rotor 12, a guide, at least one blade 14 and a housing 16. The rotor is mounted on the base. The guide connects to the base, and the blades are disposed around the rotor. The blade includes a passive part and an active part. The passive part is positioned relative to the guide and can be driven by an airflow from the guide to rotate the active part.

Referring to *Fig.* 2, an axial fan 2 of the present invention includes a base 10, a rotor 12, a guide 17, and a plurality of blades 14. The base 10 connects to a housing 16 by an extended part 15, which can be a rib (without guide function, only supporting the housing 16), or a guiding vane (with guide function). The housing 16 modifies the airflow field, and the rotor 12 pivots on the base 10 by a shaft 13. Basically, the rotor 12 is positioned on a bearing 100, and pivotally mounts on the base 10 by the bearing 100 so that the rotor 12 rotates around the shaft 13 on the base 10. The guide 17 connected to the housing 16 by at least a support 171 is a pipe to guide the airflow. The support 171 is a rib (without guide function, only supporting the housing 16), or a guiding vane (with guide function). The plurality of blades 14 are disposed around the rotor 12. When the rotor 12 rotates, the plurality of blades 14 rotate to provide heat dissipation function.

Figure 2:
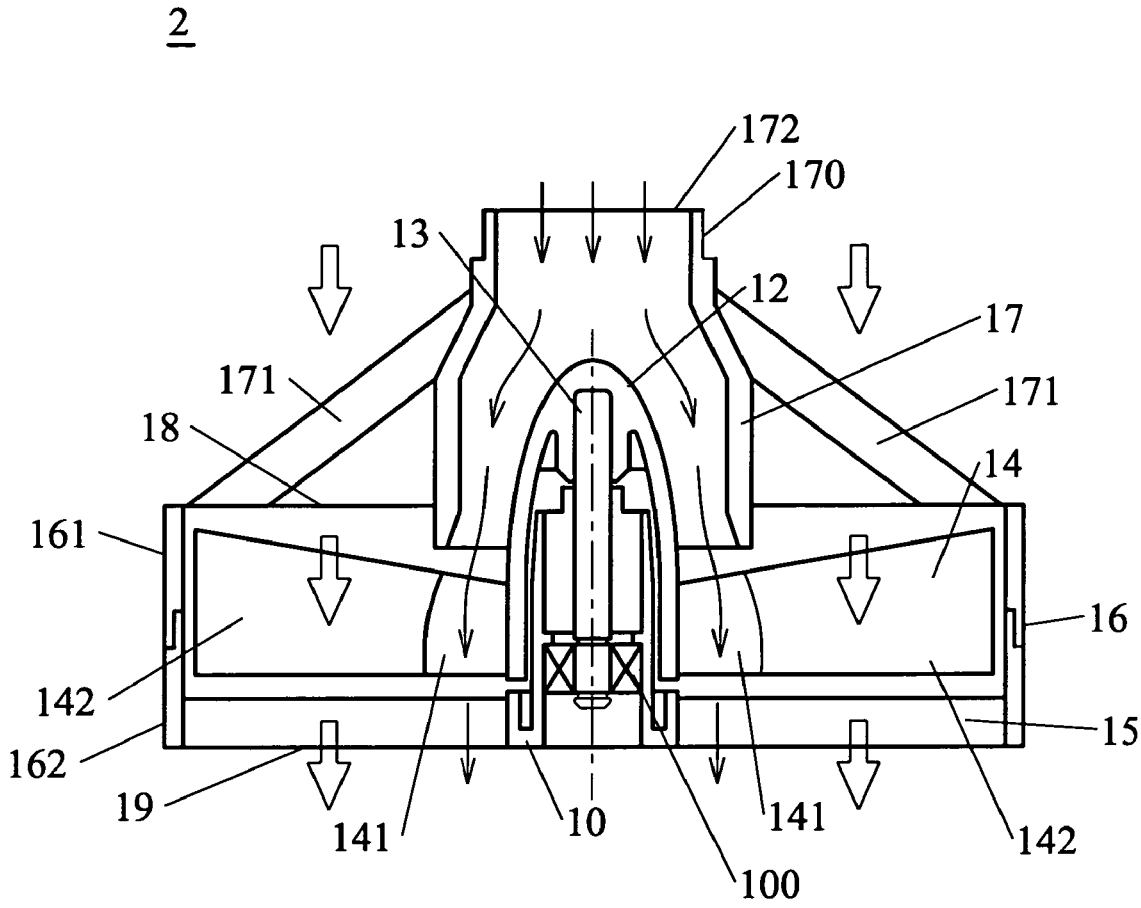
FIG. 2 is a sectional view of one embodiment of the axial fan according to the invention.
Figure 3A:
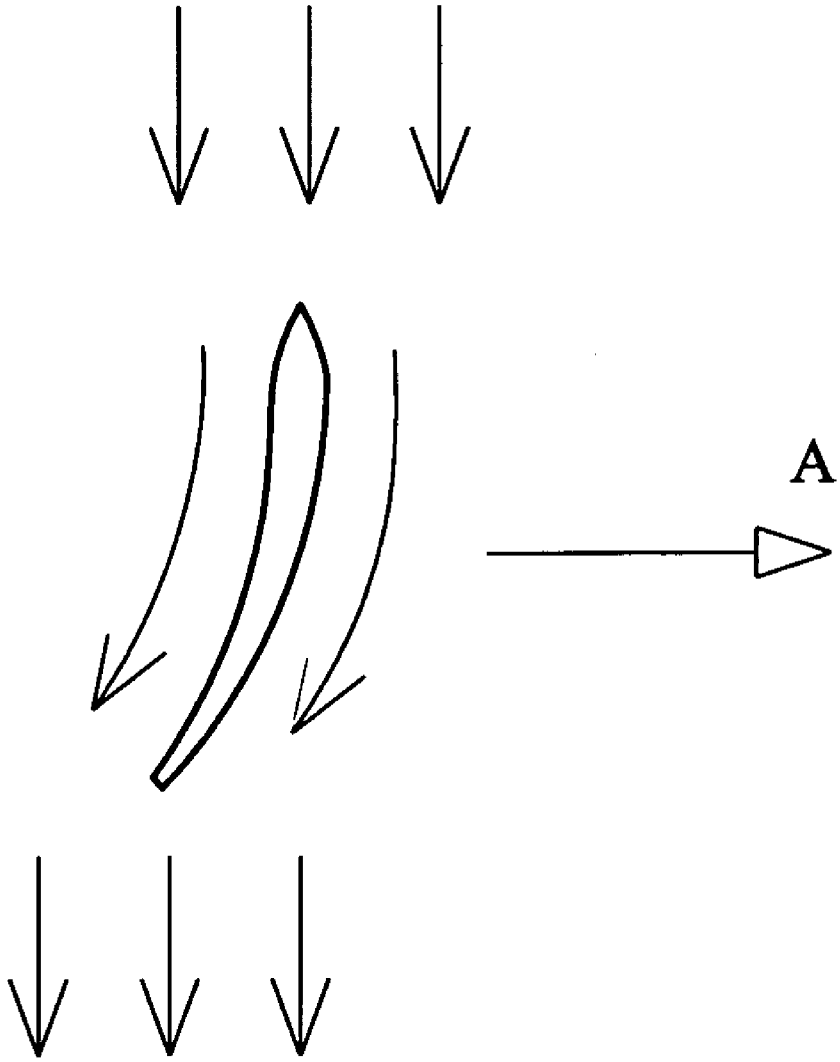
FIG. 3A is a sectional view showing a passive part of the axial fan.
Figure 3B:
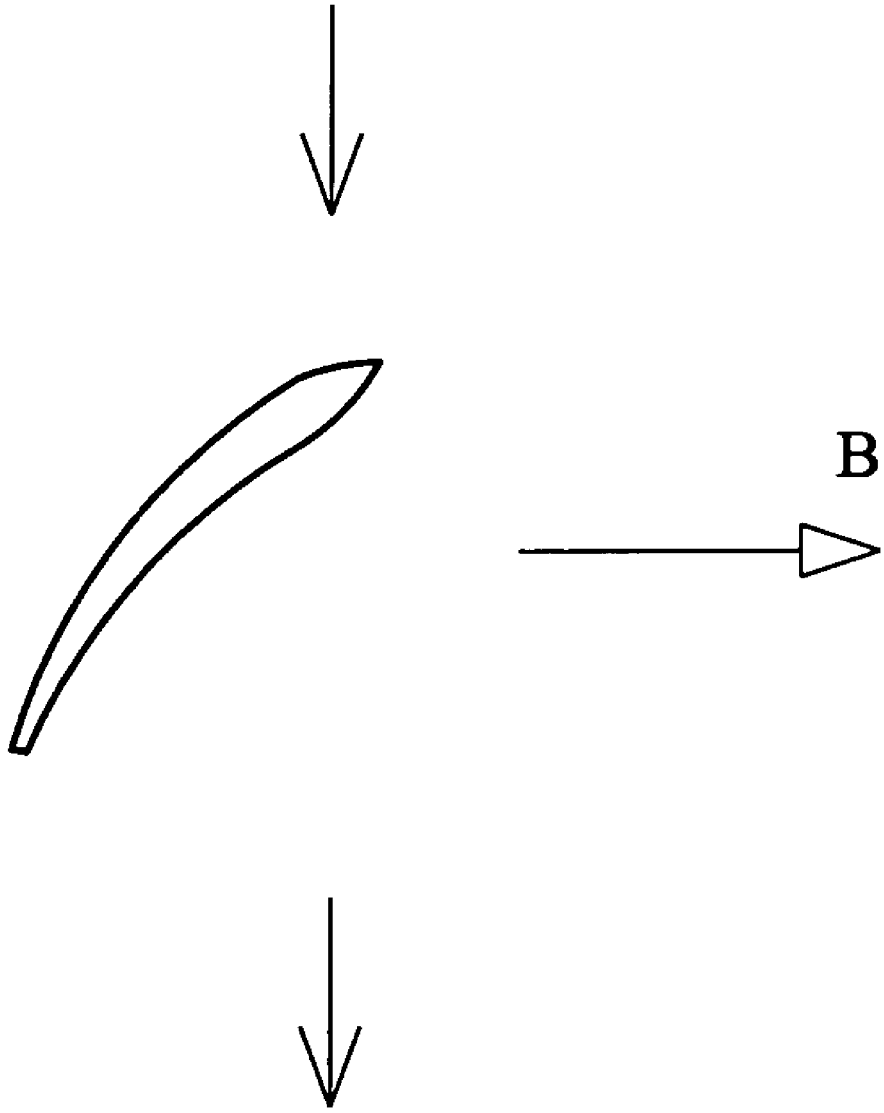
FIG. 3B is a sectional view showing an active part of the axial fan.

The present invention features a guide tube (not shown) connected to an inlet 172 of the guide 17. The guide tube connects to an air source (not shown), such as a fan motor or a blower, guiding the airflow from the air source to the guide 17. Preferably, the guide 17 has a connecting portion 170 at the inlet 172 of the guide 17 for the guide tube to connect and fix to the guide 17. Thus, the airflow is guided through the inlet 172 of the guide 17 to the plurality of blades 14 to provide a propelling power to the axial fan 2. Preferably, the rotor 12 can extend into the guide 17 (as shown in FIG. 2) to guide the airflow fluently. At the same time, a cross section of the rotor 12 can be a parabolic shape, an elliptical shape, a square shape with round corners, or a curved shape. Such design helps the guide 17 to guide the airflow fluently. Each blade 14 includes a passive part 141 and an active part 142, wherein the passive part 141 is located relative to the guide 17. FIG. 3A shows a sectional view of the passive part 141. When the airflow passes the passive part 141 (as the direction of thin arrows shown in FIG. 2), the passive part 141 divides the airflow into two parts. Because the paths on two sides of the passive part 141 are different, the velocities of the two parts of the airflow are also different. Preferably, the passive part 141 has a wing-shaped section. According to the Bernoulli's law, the relative pressure difference caused by the divided airflows drives the passive part 141 in the direction shown by arrow A in FIG. 3A. Furthermore, the passive part 141 connected to the rotor 12 extends radially outward so that the blades 14 can rotate around the shaft 13. In detail, when the blades 14 rotate around the shaft 13, the active part 142 rotates synchronously. FIG. 3B depicts a sectional view of the active part 142. The active part 142 rotates in the direction shown by arrow B in FIG. 3B. The movement of the active part 142, having the same shape as a conventional fan, causes a pressure at an outlet 19 lower than a pressure at an inlet 18. Thus, air is drawn in from the inlet 18, and flows out through the outlet 19. The air movement is demonstrated as the outline arrows shown in FIG. 2. Heat dissipation is thus provided by the axial fan 2. Preferably, the passive part 141 is near the rotor 12, and the active part 142 is away from the rotor 12. Alternatively, the passive part 141 can be disposed away from the rotor 12, or the passive part 141 can be positioned in the center of the blades 14. The goal of the present invention is to position the guide 17 at the inlet 18 of the axial fan 2 relative to the passive part 141 to rotate the blades 14.

The blades 14 and the rotor 12 rotate as the passive part 141 of the blades 14 receives the airflow from the guide 17. Next, the active part 142 of the blades 14 creates a pressure difference to circulate external air. According to Joule's Law, the air quantity (Q) multiplied by the air pressure (P) at the inlet 18 equals the air quantity (Q) multiplied by the air pressure (P) at the outlet 19. In practice, the inlet 172 provides the airflow with a higher pressure to the passive part 141 to rotate the blades 14. Air is taken into the axial fan 2 to result in increased air quantity at the outlet 19. In the mean time, the air pressure at the outlet 19 is lowered to dissipate heat from a fragile heat source. Therefore, the heat source will not be broken by the exceeding pressure. Besides, the axial fan 2 further features the guide 17, conserving fabrication time and cost.

Furthermore, the housing 16 of the axial fan 2 further includes a first case 161 and a second case 162. The support 171 connects the guide 17 and the first case 161, and the extended part 15 connects the base 10 and the second case 162. The first case 161 connects to the second case 162 by a wedge, but is not limited thereto. As a result, the first case 161 and the second case 162 can be fabricated separately. The plastic material can be used for more efficient injection molding. The manufacturing cost of the axial fan 2 is conserved even more.

Figure 4:
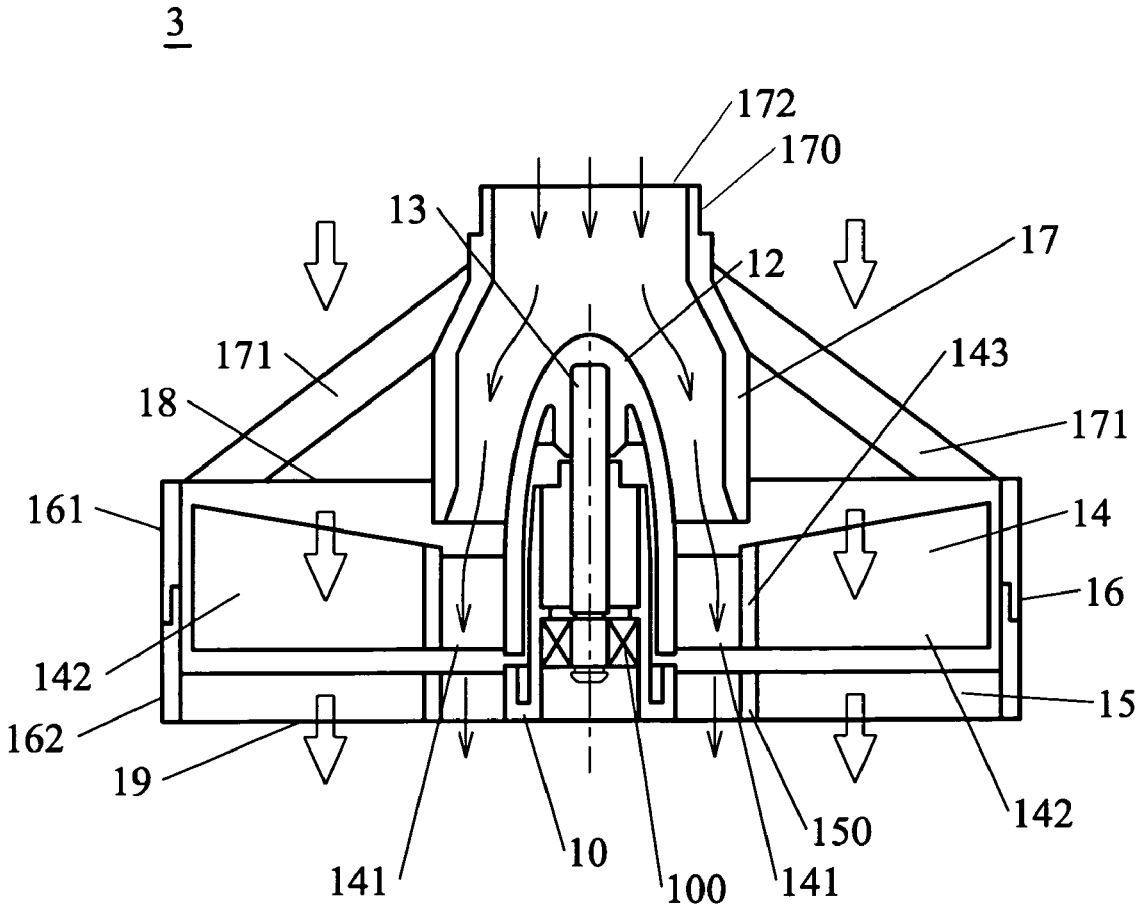
FIG. 4 is a sectional view of another embodiment of the axial fan according to the invention.

The present invention provides another embodiment, as shown in FIG. 4. The embodiment of FIG. 4 is almost the same as the embodiment of FIG. 2. To avoid interference on the airflow respectively from the passive part 141 and the active part 142, the axial fan 3 has a first partition 143 additionally disposed between the passive part 141 and the active part 142 of the blades 14. The purpose of the first partition 143 is to separate the passive part 141 and the active part 142. The first partition 143 is a complete ring, a hollow cylinder or an intermittent ring between the passive part 141 and the active part 142 on each blade 14. When the airflow provided by the inlet 172 flows through the passive part 141 (in direction shown by the thin arrows in FIG. 4), the addition of the first partition 143 prevents interference with the airflow guided by the active part 142 (airflow direction as the outline arrows shown in FIG. 4) to enhance heat dissipation. In addition, the extended part 15 of the axial fan 3 further includes a second partition 150. The second partition 150 is positioned relative to the first partition 143. The second partition 150 is a complete ring, a hollow cylinder or an intermittent ring on each extended part 15. For the same reason, the airflow through the passive part 141 and the active part 142 is divided by the second partition 150, preventing interference with the airflows. Heat dissipation efficiency of the axial fan 2 is further improved. Related structure and operating principles of the axial fan 3 have been described in the above embodiment, thus detail is omitted here.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising:

a base;

a housing connected to the base;

a rotor mounted on the base;

a guide connected to the housing by at least one support, wherein the at least one support is a guiding vane; and at least one blade disposed around the rotor, comprising a passive part positioned relative to the guide and an active part, wherein the passive part is positioned near the rotor, the active part is positioned away from the rotor, the length of the active part is longer than the length of the passive part, a top portion of the rotor extends into the guide causing the rotor to guide airflow from the inside of the guide to the passive part, and the passive part is rotated by the airflow so as to drive the active part.

2. The fan as claimed in claim 1, wherein the passive part divides the airflow from the guide into two parts so that a pressure difference produced by the two parts of the airflow can make the passive part rotate around the shaft.

3. The fan as claimed in claim 2, wherein the passive part has a wing-shaped cross section.

4. The fan as claimed in claim 1, wherein when the active part is rotating, a pressure at an outlet of the fan is lower than that at an inlet of the fan to generate air movement.

5. The fan as claimed in claim 1, further comprising a shaft coupled to the rotor and supported by a bearing mounted on the base.

6. The fan as claimed in claim 1, further comprising an extended part, wherein the extended part is located between the housing and the base.

7. The fan as claimed in claim 6, wherein the extended part is a rib or a guiding vane.

8. The fan as claimed in claim 1, wherein the housing comprises a first case and a second case, the support connects the guide and the first case, and the extended part connects the base and the second case.

9. The fan as claimed in claim 1, wherein the guide comprises a connecting portion at a feeding port of the guide for enabling a guide tube to connect with the guide.

10. The fan as claimed in claim 1, wherein the blade further comprises a first partition positioned between the passive part and the active part.

11. The fan as claimed in claim 6, wherein the extended part further comprises a second partition positioned thereon.

12. The fan as claimed in claim 1, wherein the fan is an axial fan without a motor.

13. The fan as claimed in claim 1, wherein the guide has an inlet and an outlet, the rotor extends into the outlet, and the width of the inlet is wider than the width of the outlet.

* * * * *